US007561122B2

(12) United States Patent
Choi et al.

(10) Patent No.: US 7,561,122 B2
(45) Date of Patent: Jul. 14, 2009

(54) PLASMA DISPLAY APPARATUS CAPABLE OF STABILIZING WALL CHARGES AFTER A RESET PERIOD

(75) Inventors: Yoon Chang Choi, Milyang-si (KR); Bum Joo Lee, Seoul (KR)

(73) Assignee: LG Electronics Inc, Seoul (KR)

( * ) Notice: Subject to any disclaimer, the term of this patent is extended or adjusted under 35 U.S.C. 154(b) by 787 days.

(21) Appl. No.: 11/325,420

(22) Filed: Jan. 5, 2006

(65) Prior Publication Data

US 2007/0109224 A1 May 17, 2007

(30) Foreign Application Priority Data

Nov. 14, 2005 (KR) ..... 10-2005-0108761

(51) Int. Cl.
*G09G 3/28* (2006.01)

(52) U.S. Cl. ..... 345/67; 345/55; 345/60; 345/68; 345/208; 345/209

(58) Field of Classification Search ..... 345/55, 345/60, 67, 68, 208–210
See application file for complete search history.

(56) References Cited

U.S. PATENT DOCUMENTS 5,790,087 A * 8/1998 Shigeta et al. ..... 345/67
6,037,916 A * 3/2000 Amemiya ..... 345/60
6,195,072 B1 * 2/2001 Iwami et al. ..... 345/67
6,211,865 B1 * 4/2001 Hosoi et al. ..... 345/204
6,243,084 B1 * 6/2001 Nagai ..... 345/210
6,262,699 B1 * 7/2001 Suzuki et al. ..... 345/68
6,342,874 B1 * 1/2002 Tokunaga et al. ..... 345/68
6,414,653 B1 * 7/2002 Kobayashi ..... 345/60
6,707,436 B2 * 3/2004 Setoguchi et al. ..... 345/60
6,906,690 B2 * 6/2005 Lim ..... 345/60
7,109,951 B2 * 9/2006 Kim et al. ..... 345/63
7,218,292 B2 * 5/2007 Kashio et al. ..... 345/60
7,468,712 B2 * 12/2008 Son et al. ..... 345/60
2005/0225509 A1 10/2005 Choi et al. ..... 345/60

FOREIGN PATENT DOCUMENTS

CN 1684123 A 10/2005

OTHER PUBLICATIONS

Chinese Office Action dated Mar. 14, 2008.
European Search Report dated Apr. 26, 2006.

* cited by examiner

*Primary Examiner*—Richard Hjerpe
*Assistant Examiner*—Gregory J Tryder
(74) *Attorney, Agent, or Firm*—Ked & Associates, LLP

(57) ABSTRACT

The present invention is related to a plasma display panel, in particular to a plasma display apparatus capable of preventing an error discharge or an error writing of a discharge cell. A plasma display apparatus according to an embodiment of the present invention comprises a plasma display panel including a scan electrode and a sustain electrode; and a controller for applying a negative waveform and a positive waveform to the scan electrode between a reset pulse and a scan pulse having negative polarity, wherein the controller applies a sustain bias voltage to the sustain electrode when the negative waveform is applied to the scan electrode.

20 Claims, 12 Drawing Sheets

PLASMA DISPLAY APPARATUS CAPABLE OF STABILIZING WALL CHARGES AFTER A RESET PERIOD

This application claims the benefit of Korean Patent Application No. 10-2005-0108761, filed on Nov. 14, 2005, which is hereby incorporated by reference for all purposes as if fully set forth herein.

BACKGROUND OF THE INVENTION

1. Field of the Invention

This document is related to a plasma display panel, in particular to a plasma display apparatus capable of preventing an error discharge or an error writing of a discharge cell.

2. Description of the Background Art

In a conventional plasma display panel, one unit cell is provided at a space between barrier ribs formed between a front panel and a rear panel. A main discharge gas such as neon (Ne), helium (He) or a mixture (He+Ne) of neon and helium and an inert gas containing a small amount of xenon (Xe) fill each cell. When a discharge occurs using a high frequency voltage, the inert gas generates vacuum ultraviolet rays and phosphors provided between the barrier ribs are stimulated to emit light, thereby realizing an image. The plasma display panel is considered as one of the next generation display devices due to its thin profile and light weigh construction.

FIG. 1 illustrates a structure of a conventional plasma display panel.

As shown in FIG. 1, a plasma display panel includes a front panel 100 and a rear panel 110. The front panel 100 has a plurality of sustain electrode pairs arranged with a scan electrode 102 and a sustain electrode 103 each paired and formed on a front glass 101, which is a display surface for displaying the image thereon. The rear panel 110 has a plurality of address electrodes 113 arranged to intersect with the plurality of sustain electrode pairs on a rear glass 111, which is spaced apart in parallel with and sealed to the front panel 100.

The front panel 100 includes the paired scan electrode 102 and the paired sustain electrode 103 for performing a mutual discharge in one pixel and sustaining an emission of light. Each of the paired scan electrode 102 and the paired sustain electrode 103 has a transparent electrode (a) formed of indium-tin-oxide (ITO) and a bus electrode (b) formed of metal. The scan electrode 102 and the sustain electrode 103 are covered with at least one dielectric layer 104, which controls a discharge current and insulates the paired electrodes. A protective layer 105 is formed of oxide magnesium (MgO) on the dielectric layer 104 to facilitate a discharge condition.

The rear panel 110 includes stripe-type (or well-type) barrier ribs 112 for forming a plurality of discharge spaces or discharge cells arranged in parallel. The rear panel 110 includes a plurality of address electrodes 113 performing an address discharge are arranged in parallel with the barrier ribs 112. Red (R), green (G) and blue (B) phosphors 114 emit visible rays for displaying the image in the sustain discharge and are coated over an upper surface of the rear panel 110. A dielectric layer 115 for protecting the address electrode 113 is formed between the address electrode 113 and the phosphor 114.

FIG. 2*a* illustrates driving waveforms of a plasma display panel in a related art.

As shown in FIG. 2*a*, the plasma display panel is driven with a frame divided into a reset period for initializing the entire cells, an address period for selecting a cell to be discharged, a sustain period for sustaining the discharge of the selected cell and an erase period for erasing wall charges within discharged cells.

In the setup period of the reset period, a ramp-up waveform (Ramp-up) is applied to the entire scan electrodes at the same time. The ramp-up waveform generates a weak dark discharge within discharge cells of the entire screen. The setup discharge causes positive wall charges to be accumulated on the address electrodes and the sustain electrodes, negative wall charges to be accumulated on the scan electrodes.

In the setdown period of the reset period, after the ramp-up waveform is applied, a ramp-down waveform (Ramp-down), which starts falling from a positive voltage lower than a peak voltage of the ramp-up waveform up to a predetermined voltage level lower than a ground (GND) level voltage, generates a weak erase discharge within cells, thereby sufficiently erasing wall charges excessively formed on the scan electrodes. Wall charges sufficient for a stable address discharge are uniformly remained within the cells due to the the setdown discharge.

In the address period, while negative scan pulses are sequentially applied to the scan electrodes, address pulses having a positive polarity is applied to the address electrodes in synchronization with the scan pulse. As a voltage difference between the scan pulse and the address pulse and a wall voltage generated in the reset period are added, an address discharge is generated within discharge cells to which the address pulse is applied. Wall charges that can cause a discharge when a sustain voltage (Vs) is applied are generated within cells selected by an address discharge. The sustain electrodes are supplied with a positive voltage (Vz) in order that an erroneous discharge is not generated between the sustain electrode and the scan electrode by reducing the voltage difference between the sustain electrode and the scan electrode during the setdown period and the address period.

In the sustain period, a sustain pulse is alternately applied to the scan electrodes and the sustain electrodes. In a cell selected by an address discharge, a sustain discharge, i.e., a display discharge is generated between the scan electrodes and the sustain electrodes whenever the sustain pulse is applied as the wall voltage within the cell and the sustain pulse are added.

After the sustain discharge is completed, in the erase period, an erase ramp waveform (Ramp-ers) having a narrow pulse width and a low voltage level is applied to the sustain electrodes, thereby wall charges remaining within the cells of the entire screen are erased.

The distribution of wall charges in the discharge cell due to a driving pulse is shown in FIG. 2.

FIG. 2*b* illustrates wall charges distributed in a discharge cell according to driving pulses of a related art.

Referring to FIG. 2*b*, during the setup period, negative wall charges are formed in the scan electrode(Y), positive wall charges are formed in the sustain electrode(Z). During the setdown period, Ramp-Down waveform, falling from a positive voltage lower than the peak voltage of Ramp-Up waveform, is applied to the scan electrode. Accordingly, excessive wall charges which are unnecessary and unbalanced are erased, therefore, wall charges within a cell are decreased in a moderate amount.

Then, during the address period, a negative voltage is applied to the scan electrode(Y), a positive voltage is applied to the sustain electrode(Z). In this time, an address discharge is happened by adding the voltage, negative, of wall charges formed in a setdown period to the negative voltage applied to the scan electrode(Y).

The plasma display panel of the related art described above is able to generate a stable address discharge, only when optimized wall charges are formed during the reset period. However, sometimes, one can not obtain optimized wall charges according to the characteristics of the panel, which results in an error discharge and or an error writing of discharge cell.

FIG. 3 illustrates wall charges formed in some discharge cells among discharge cells according to driving pulses of a related art. As shown in FIG. 3, in some discharge cells, negative wall charges are formed in the scan electrode(Y), excessive positive wall charges are formed in an address electrode(X), in set down period. As described above, the positive wall charges excessively formed in the address electrode(X) undesirably performs an address discharge within the discharge cell to which data pulse is not applied. Therefore, a luminescent spot error discharge or a mistaken writing are happened to deteriorate the definition of a plasma display panel.

SUMMARY OF THE INVENTION

Accordingly, an object of the present invention is to solve at least the problems and disadvantages of the background art.

The object of the present invention is to provide a plasma display panel capable of preventing an error discharge and an error writing of a discharge cell.

A plasma display apparatus according to an embodiment of the present invention comprises a plasma display panel including a scan electrode and a sustain electrode; and a controller for applying a negative waveform and a positive waveform to the scan electrode between a reset pulse and a scan pulse having negative polarity, wherein the controller applies a sustain bias voltage to the sustain electrode when the negative waveform is applied to the scan electrode.

A plasma display apparatus according to another embodiment of the present invention comprises a plasma display panel comprising a scan electrode and a sustain electrode; and a controller for applying a negative waveform and a positive waveform to the scan electrode between a reset pulse and a scan pulse having negative polarity, wherein the controller applies a sustain bias voltage to the sustain electrode when the negative waveform is applied to the scan electrode, wherein the controller applies a ground level voltage to the sustain electrode when the positive waveform is applied to the scan electrode.

A plasma display apparatus according to still another embodiment of the present invention comprises a plasma display panel comprising a scan electrode and a sustain electrode; and a controller for applying a negative waveform and a positive waveform to the scan electrode between a reset pulse and a scan pulse having negative polarity, wherein the controller applies a sustain bias voltage to the sustain electrode when the negative waveform is applied to the scan electrode, applies a narrow pulse having a width less than half of the sustain pulse width to the sustain electrode after the positive waveform is applied to the scan electrode.

A plasma display apparatus according to the embodiments is capable of preventing an error discharge or an error writing of a discharge cell.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Figure 1:
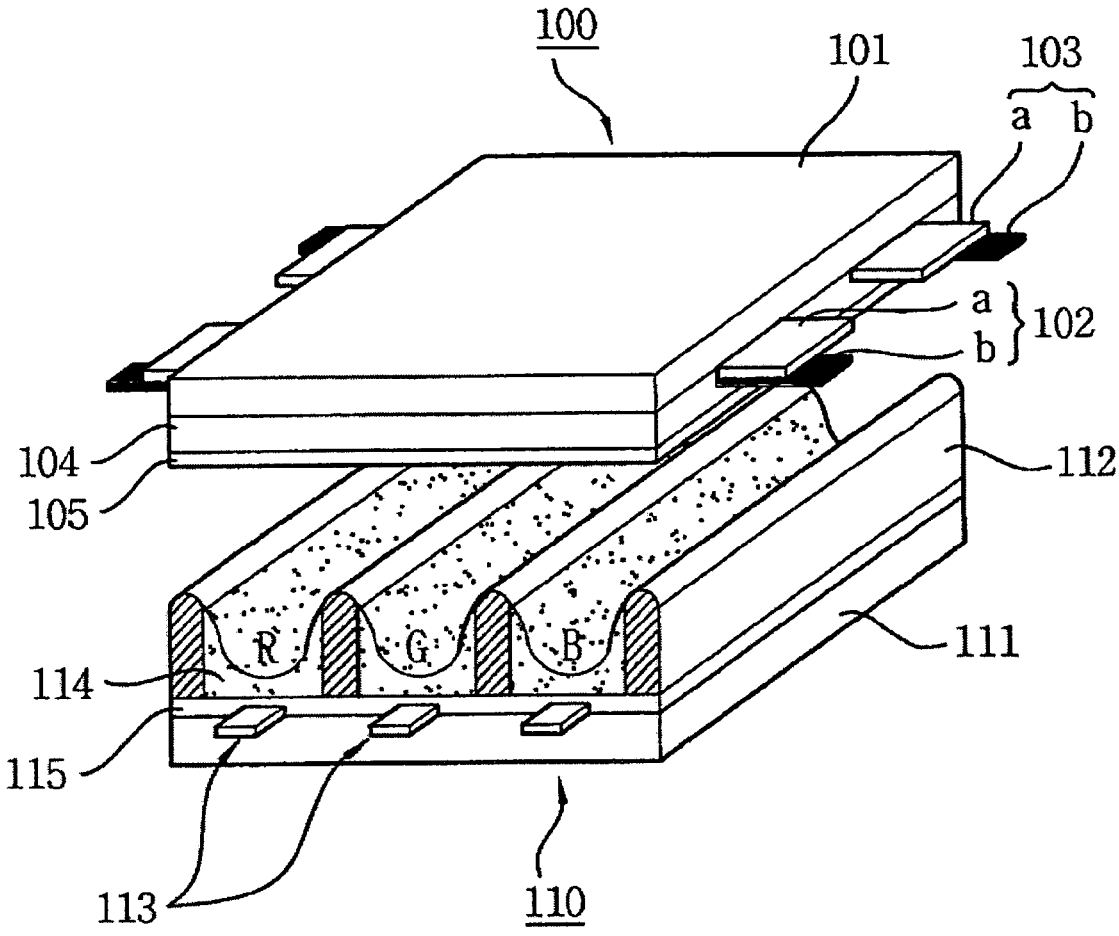
FIG. 1 illustrates a structure of a conventional plasma display panel.
Figure 2A:
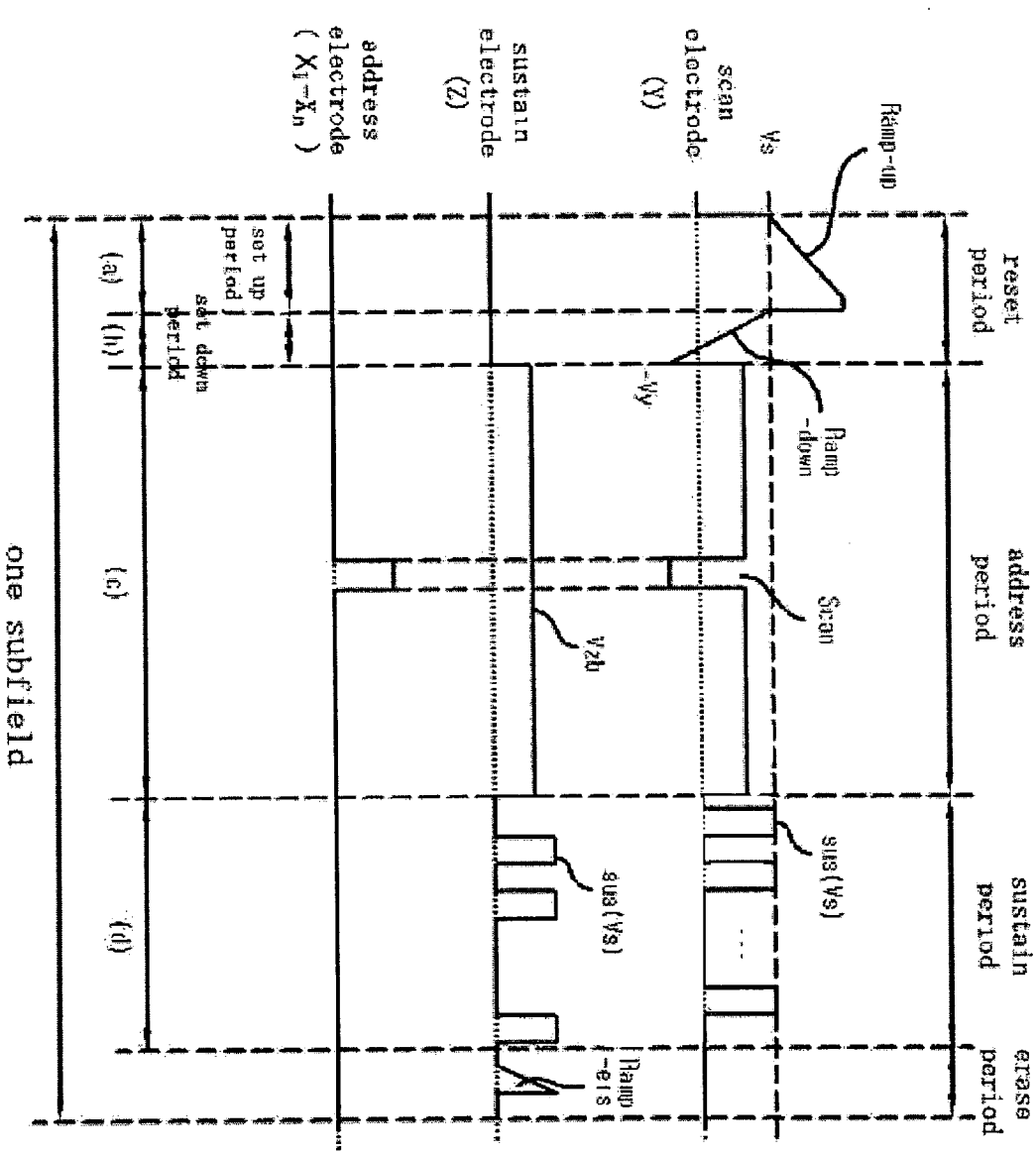
FIG. 2*a* illustrates driving waveforms of a plasma display panel of a related art.
Figure 2B:
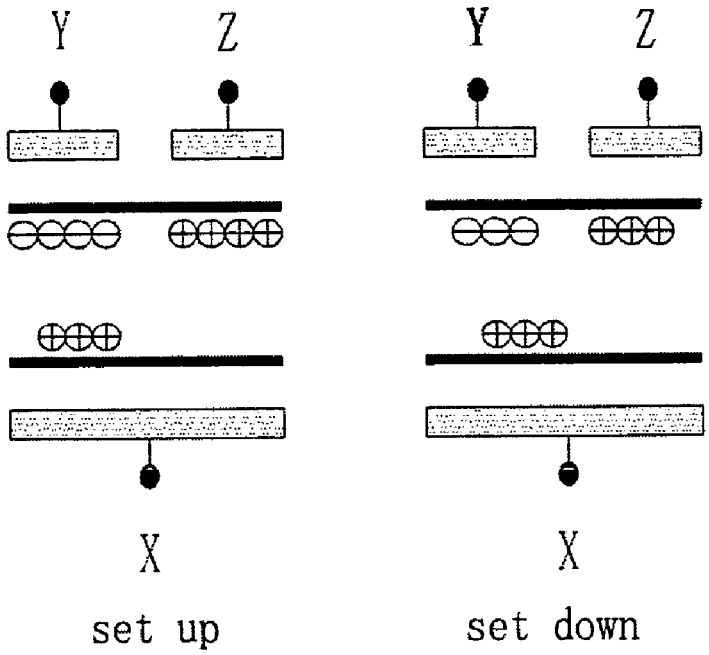
FIG. 2*b* illustrates wall charges distributed in a discharge cell according to driving pulses of a related art.
Figure 3:
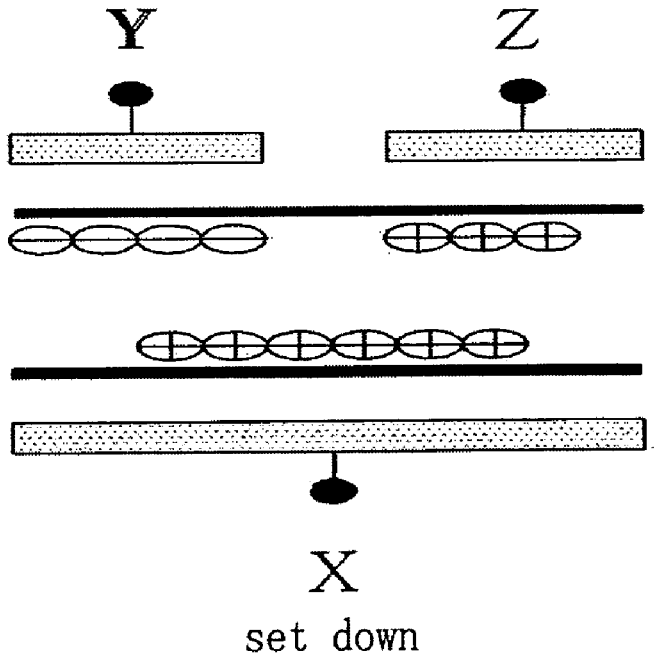
FIG. 3 illustrates wall charges formed in some discharge cells among discharge cells according to driving pulses of a related art.

Exemplary embodiments of the present invention will be described in a more detailed manner with reference to the drawings.

A plasma display apparatus according to an example of the embodiment comprises a plasma display panel including a scan electrode and a sustain electrode; and a controller for applying a negative waveform and a positive waveform to the scan electrode between a reset pulse and a scan pulse having negative polarity, wherein the controller applies a sustain bias voltage to the sustain electrode when the negative waveform is applied to the scan electrode.

The negative waveform and the positive waveform are applied from a first voltage level.

The sustain bias voltage is lower than a sustain voltage.

The sustain electrode is applied with a ground level voltage, when the positive waveform is applied to the scan electrode.

The first voltage level ranges from −90V to −70V.

The peak value of the negative waveform ranges from −210V to −190V.

The scan pulse is applied from the first voltage level.

The width of the negative waveform ranges from 1 μs to 10 μs.

The width of the negative waveform is substantially the same with a width of the scan pulse or wider than the width of the scan pulse.

The negative waveform is applied from a second voltage level and the positive waveform is applied from a third voltage level.

The second voltage level ranges from 50V to 80V.

The peak value of the negative waveform ranges from −70V to −40V.

The third voltage level ranges from −10V to 10V.

The second voltage level is a ground level voltage.

A plasma display apparatus according to another example of the embodiment comprises a plasma display panel comprising a scan electrode and a sustain electrode; and a controller for applying a negative waveform and a positive waveform to the scan electrode between a reset pulse and a scan pulse having negative polarity, wherein the controller applies a sustain bias voltage to the sustain electrode when the negative waveform is applied to the scan electrode, wherein the controller applies a ground level voltage to the sustain electrode when the positive waveform is applied to the scan electrode.

The positive waveform is a rising pulse.

The sustain bias voltage is lower than a sustain voltage.

A plasma display apparatus according to still another example of the embodiment comprises a plasma display panel comprising a scan electrode and a sustain electrode; and a controller for applying a negative waveform and a positive waveform to the scan electrode between a reset pulse and a scan pulse having negative polarity, wherein the controller applies a sustain bias voltage to the sustain electrode when the negative waveform is applied to the scan electrode, applies a narrow pulse having a width less than half of the sustain pulse width to the sustain electrode after the positive waveform is applied to the scan electrode.

The positive waveform is a rectangular pulse.

The sustain bias voltage is lower than a sustain voltage.

Reference will now be made in detail to embodiments of the present, examples of which are illustrated in the accompanying drawings.

A First Embodiment

Figure 4:
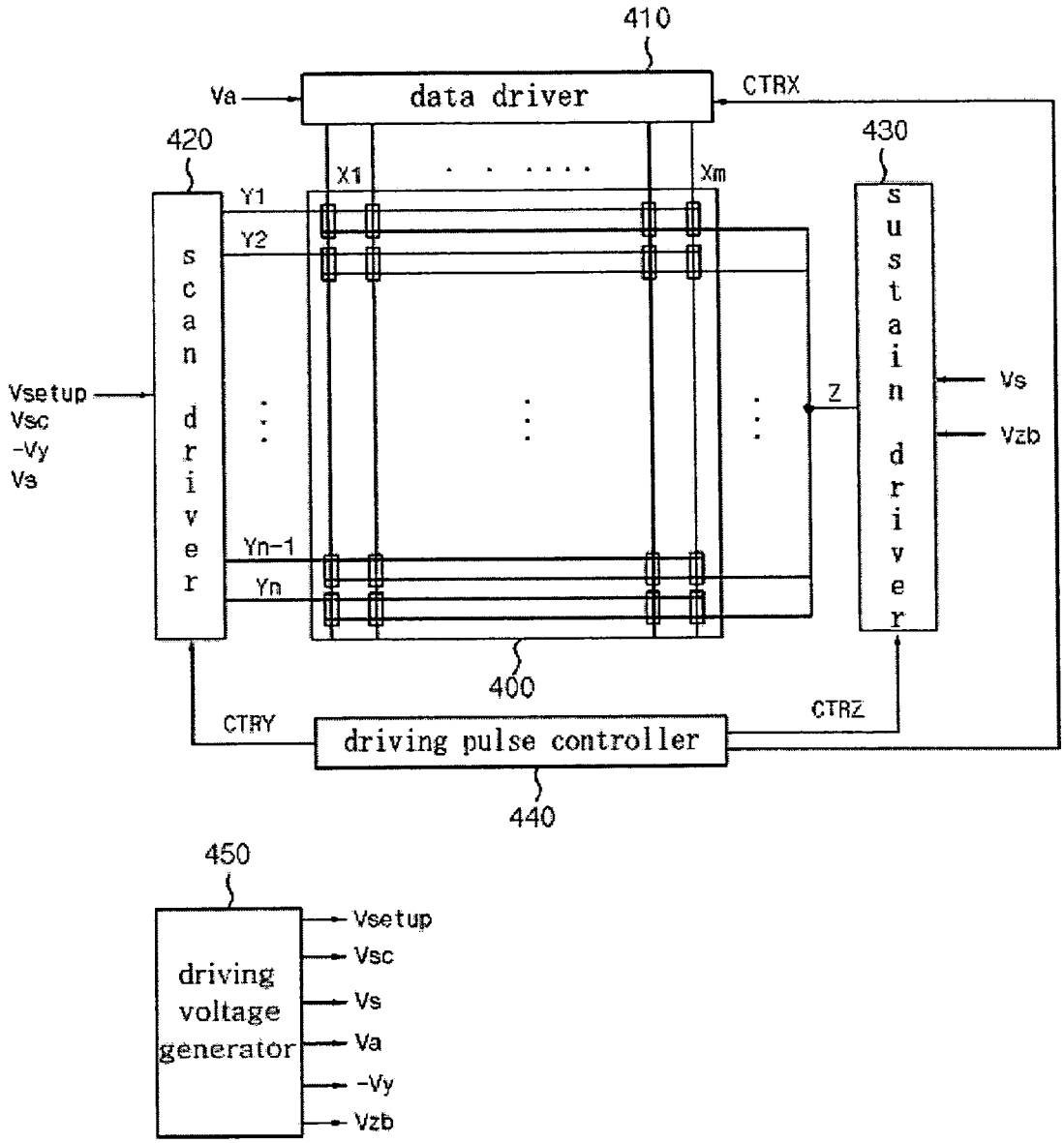
FIG. 4 illustrates a structure of a plasma display apparatus according to embodiments of the present invention.

Referring FIG. 4 to FIG. 7, a plasma display apparatus according to a first embodiment of the present invention will be explained. FIG. 4 illustrates a structure of a plasma display apparatus according to embodiments of the present invention.

As shown in FIG. 4, plasma display apparatus according to embodiments of the present invention comprises a plasma display panel 400, a data driver 410, a scan driver 420, a sustain driver 430, a driving pulse controller 440 and a driving voltage generator 450.

The plasma display panel 420 comprises a plurality of scan electrodes Y1 to Yn, a plurality of sustain electrodes z and a plurality of address electrodes X1 to Xm that intersect the scan electrodes Y1 to Yn and the sustain electrodes z.

The data driver 410 applies a data to address electrodes X1 to Xm formed in the plasma display panel 400. In this case, the data means an image signal data which is processed in an image signal processor(not shown) where image signals inputted from the outside are processed.

The data driver 410 samples and latches the data in response to a data timing control signal CTRX from the driving pulse controller 440, and then supplies the address pulses having an address voltage Va to address electrodes X1 to Xm.

The driving pulse controller 440 controls the data driver 410, the scan driver 420 and the sustain driver 430, when the plasma display panel 400 is driven.

In other words, the driving pulse controller 440 generates timing control signals CTRX, CTRY, CTRZ for controlling an operation timing and synchronization of the data driver 410, the scan driver 420 and the sustain driver 430 during a reset period, an address period and a sustain period, transmits the timing control signals CTRX, CTRY, CTRZ to each driver 410, 420, 430.

The data control signal CTRX includes a sampling clock for sampling data, a latch control signal and a switch control signal for controlling the on/off time of an energy recovery circuit in the data driver 410 and a driving switch device. The scan control signal CTRY includes a switch control signal for controlling the on/off time of an energy recovery circuit in the scan driver 420 and a driving switch device. The sustain control signal CTRZ includes a switch control signal for controlling the on/off time of an energy recovery circuit in the sustain driver 430 and a driving switch device.

The scan driver 420 drives the scan electrodes Y1 to Yn formed in the plasma display panel 400. The scan driver 420, under the control of the driving pulse controller 440, supplies set-up pulse and set-down pulse representing a ramp-waveform formed by the combination of Vs, Vsetup and −Vy to the scan electrodes Y1 to Yn during reset period.

The driving pulse controller 440 according to the first embodiment of the present invention applies, between a reset pulse and a negative scan pulse, a negative waveform and a positive waveform to the scan electrodes by the scan driver 420. The negative waveform performs erasing wall charges excessively accumulated in the address electrodes X1 to Xm of the discharge cells which are not turned off. The positive waveform performs erasing wall charges excessively accumulated in the scan electrodes Y1 to Yn and the sustain electrodes z. The driving pulse controller 440 supplies a reference voltage to the sustain electrodes z when the positive waveform is applied the scan electrode, supplies a sustain bias voltage to the sustain electrodes z when the negative waveform is applied the scan electrode, by the sustain driver 430 for erasing some wall charges. In FIG. 5*a* to FIG. 7, it will be described in detail.

Then, a scan pulse applied from a scan reference voltage Vsc to a scan voltage −Vy is sequentially applied to each of the scan electrodes Y1 to Yn during the address period.

The scan driver 420 applies at least one sustain pulse applied from a ground level to a sustain voltage Vs to the scan electrodes Y1 to Yn for sustain discharge during the sustain period.

The sustain driver 430 drives the sustain electrodes z formed as a common electrode in the plasma display panel 400.

The driving pulse controller 440 according to the first embodiment of the present invention supplies the reference voltage GND to the sustain electrodes z when the positive waveform is applied the scan electrodes Y1 to Yn, supplies the sustain bias voltage to the sustain electrodes z when the negative waveform is applied the scan electrode. The driving pulse controller 440 applies the bias voltage to the sustain electrodes z during the address period, applies at least one sustain pulse, applied from the reference voltage level GND to a sustain voltage Vs, to the sustain electrodes z for sustain discharge during the sustain period.

The driving voltage generator 450 generates and supplies a driving voltage for the driving pulse controller 440 and each driver 410, 420, 430. The driving voltage generator 450 generates a set-up voltage Vsetup, a scan reference voltage Vsc, a scan voltage −Vy, a sustain voltage Vs, an address voltage Va and a bias voltage Vzb. The driving voltages described above can be controlled depending on the composition of a discharge gas or the structure of a discharge cell. Driving pulses applied to a plasma display apparatus according to the first embodiment of the present invention and wall charges distributed in the plasma display panel are shown in FIG. 5*a* to FIG. 5*b*.

Figure 5A:
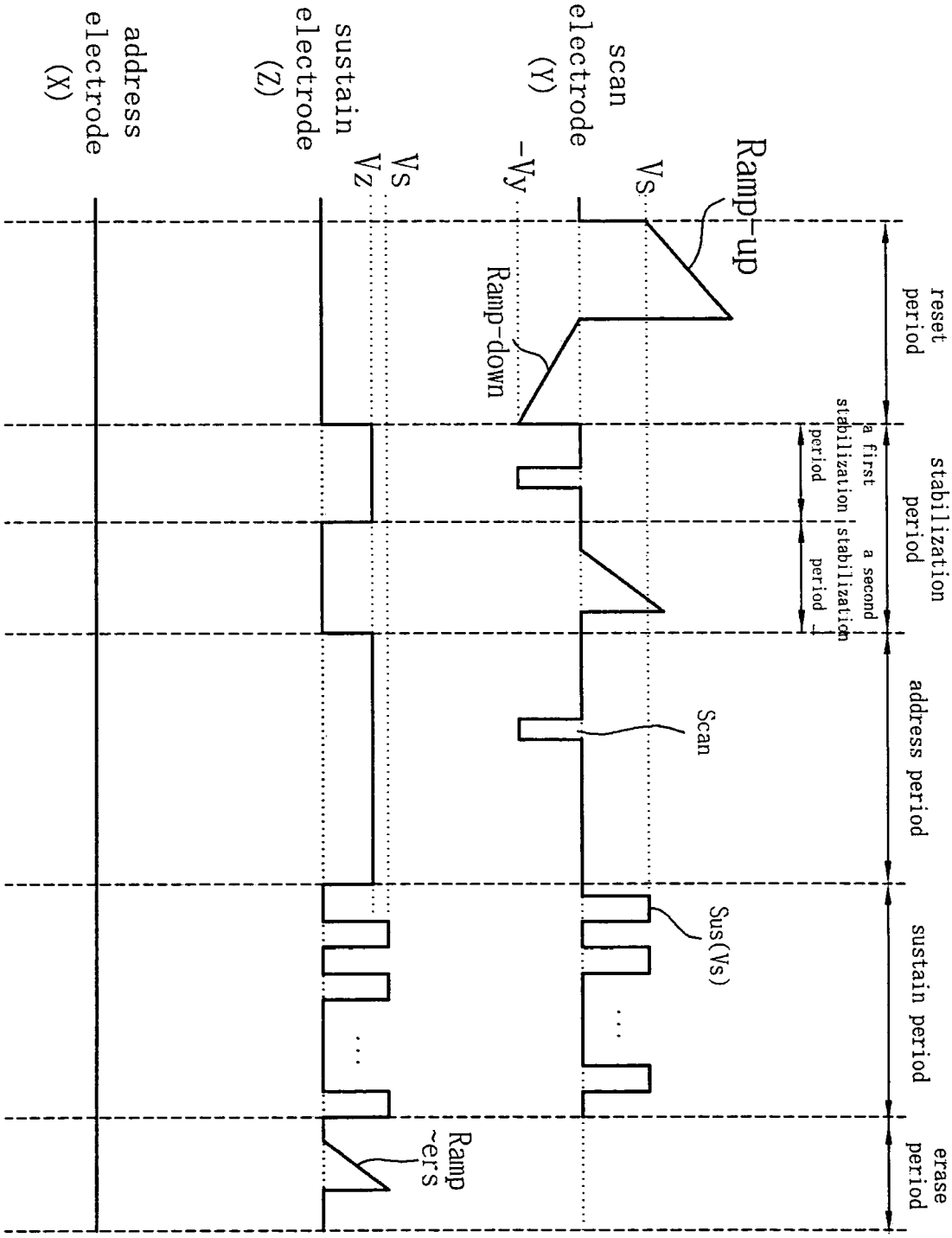
FIG. 5*a* illustrates an example of driving waveforms of a plasma display apparatus according to a first embodiment of the present invention.
Figure 5B:
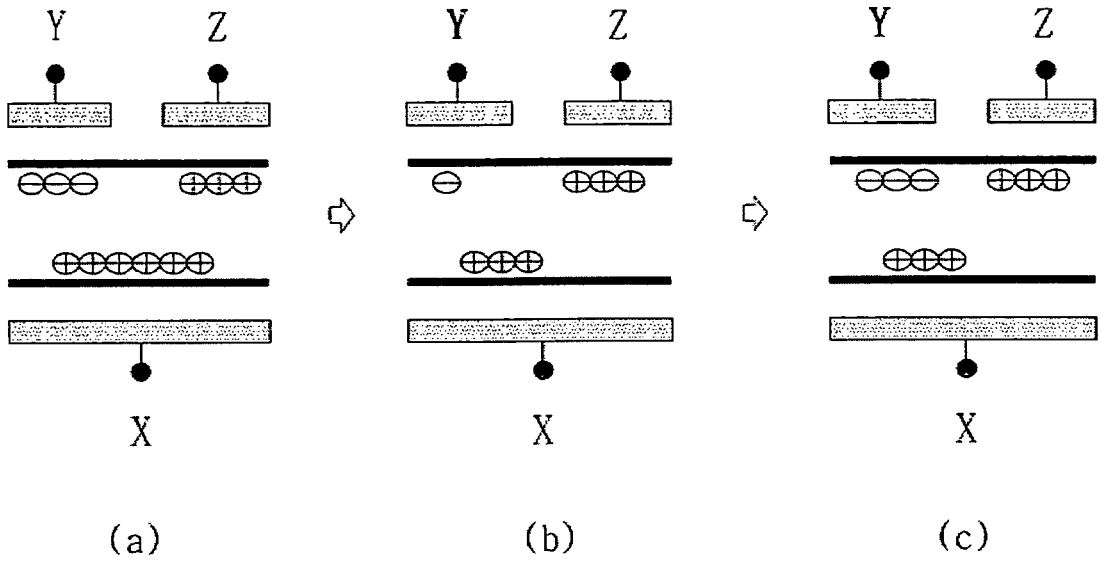
FIG. 5*b* illustrates wall charges distributed in a discharge cell due to a driving pulse according to a first embodiment of the present invention.

FIG. 5*a* illustrates an example of driving waveforms of a plasma display apparatus according to the first embodiment of the present invention.

As shown in FIG. 5*a*, the plasma display apparatus according to the first embodiment of the present invention is driven with a reset period for initializing all discharge cells, a stabilization period for stabilizing excessive wall charges distribution within the discharge cell, an address period for selecting a discharge cell, a sustain period for sustaining discharge of the selected cell and an erase period for erasing wall charges within the discharged cell.

In the reset period, Ramp-up waveform is simultaneously applied to all scan electrodes in set-up period. This Ramp-up waveform causes dark discharges within discharge cells of the entire screen. Due to this set-up discharge, positive wall charges are accumulated in the address electrode and the sustain electrode, negative wall charges are accumulated in the scan electrode.

In the set-down period, Ramp-down waveform falling from the reference voltage level GND to a predetermined voltage level −Vy generates an erase discharge between the scan electrode and the sustain electrode. Thus, wall charges formed between the scan electrode and the sustain electrode are enoughly erased. Due to this set-down discharge, wall charges enough to generate a stable address discharge are uniformly remained within the cells.

In the stabilization period, the first embodiment of the present invention selectively erases wall charges formed between the scan electrode and the sustain electrode for preventing an error discharge due to a residual image. For the erasing, the positive waveform and the negative waveform are applied to the scan electrode between the reset pulse and the negative scan pulse. Preferably, the negative waveform is a rectangular waveform. The negative waveform is applied from a first voltage level. Preferably, the first voltage level ranges from −90V to −70V. Preferably, the peak voltage of the negative waveform ranges from −210V to −190V. Preferably, the width of the negative waveform is approximately the same with the width of the scan pulse or wider than the width of the scan pulse. Preferably, the width of the negative waveform ranges from 1 μs to 10 μs. The width and magnitude of the waveform are properly set to erase some negative wall charges of the scan electrode and a part of excessive positive wall charges of the address electrode in proper.

The sustain bias voltage Vz is applied to the sustain electrode when the negative waveform is applied to the scan electrode. Preferably, the sustain bias voltage Vz ranges from 80V to 100V. Due to the application of the negative waveform, a weak erase discharge is happened between the scan electrode and the address electrode.

Then, a positive waveform is applied to the scan electrode after the negative waveform is applied to the scan electrode. In this case, the positive waveform is a rising waveform rises from the first voltage level with a predetermined slope. The positive rising waveform rises to a voltage level that is approximately the same with a sustain pulse voltage level Vs applied during the sustain period after the address period. Preferably, the peak voltage level of the positive waveform ranges from 150V to 250V. Accordingly, wall charges, which are enough for a stable address discharge in the scan electrode Y and the sustain electrode Z, are uniformly remained.

A reference voltage is applied to the sustain electrode when the positive waveform is applied to the scan electrode.

By performing the erase discharge, excessive wall charges accumulated in the cells, which are turned off in the region representing a single color pattern during operation, are selectively erased to efficiently improve a luminescent spot problem. In FIG. 5*b*, the more explanation will be described in detail.

During the address period, the negative scan pulse is sequentially applied to the scan electrodes, while the positive address pulse is applied to the address electrodes in synchronization with the scan pulse. The address discharge is happened in the discharge cell to which the address pulse is applied, by adding a voltage difference between the scan pulse and the address pulse to a wall voltage formed during the reset period. Wall charges enough for discharges by sustain voltage are formed within the cells selected by address discharge. A positive sustain bias voltage Vz is applied to the sustain electrode so that an error discharge between the scan electrode and the sustain electrode may not be happened by decreasing the voltage difference between the scan electrode and the sustain electrode during the set-down period and the address period.

During the sustain period, the sustain pulse Sus having the magnitude of sustain voltage Vs is alternately applied to the scan electrode and the sustain electrode. In the selected cell by the address discharge, a sustain discharge between the scan electrode and the sustain electrode, that is, a display discharge is happened whenever the sustain pulse is applied with adding wall charges within the cell to the sustain pulse.

After the completion of sustain discharge, during the erase period, an erase ramp waveform Ramp-ers having a small pulse width and a low voltage level is applied to the sustain electrode, then, wall charges remained in the cells of the entire screen are erased. In FIG. 5*b*, the explanations on wall charges distributed within the cell due to a driving pulse according to a first embodiment of the present invention will be described.

FIG. 5*b* illustrates wall charges distributed in a discharge cell due to the driving pulse according to the first embodiment of the present invention.

Referring FIG. 5, negative wall charges are formed in a scan electrode Y during the set-down period of the reset period, excessive positive wall charges are formed in an address electrode X (a). During a stabilization period, before an address period, a negative waveform is applied to the scan electrode Y, which causes that some of negative wall charges in the scan electrode Y and some of excessive positive wall charges in the address electrodes X are erased (b). During a second stabilization period before the address period, a positive waveform is applied to the scan electrode Y, a reference voltage is applied to the sustain electrode Z. Wall charges enough for a stable address discharge between the scan electrode Y and the sustain electrode Z are uniformly remained (c). Accordingly, a mistaken writing or a luminescent spot error discharge can be prevented.

Figure 6:
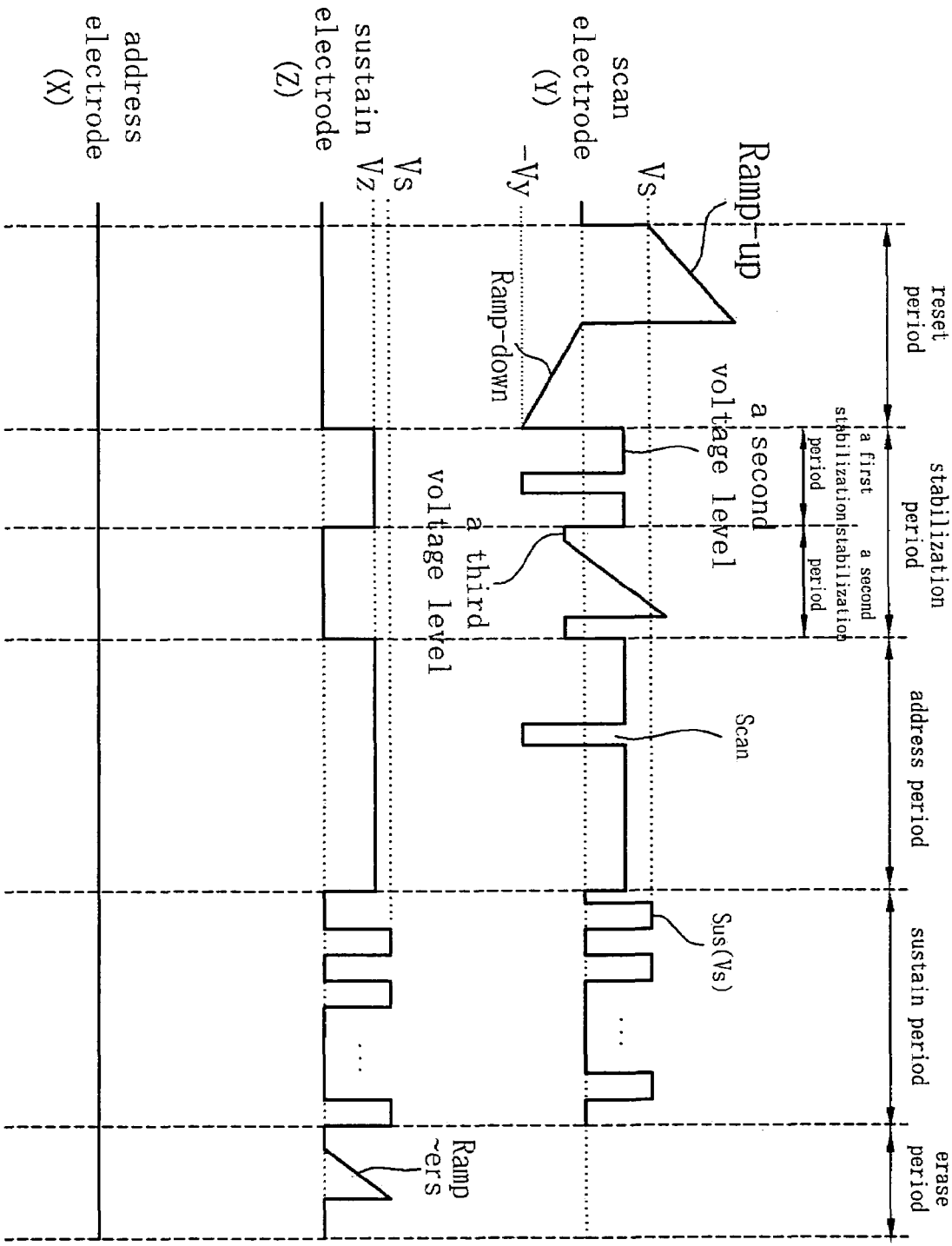
FIG. 6 illustrates another example of driving waveforms of a plasma display apparatus according to a first embodiment of the present invention.

FIG. 6 illustrates another example of driving waveforms of the plasma display apparatus according to the first embodiment of the present invention.

As shown in FIG. 6, the driving pulse applied in a reset period, an address period, a sustain period and an erase period is the same with the driving pulse shown in FIG. 5*a*. In a first stabilization period, a negative waveform applied to a scan electrode Y is applied from a second voltage level. In other words, the second voltage level, different from the first voltage level of FIG. 5*a*, is positive and applied from the voltage level which ranges from 50V to 80V. Accordingly, the lowest voltage level ranges from −70V to −40V. The positive rising waveform described above rises from a third voltage level. Preferably, the third voltage level ranges from −10V to 10V. Thus, wall charges are properly erased according to the amount of wall charges accumulated in an address electrode X.

Figure 7:
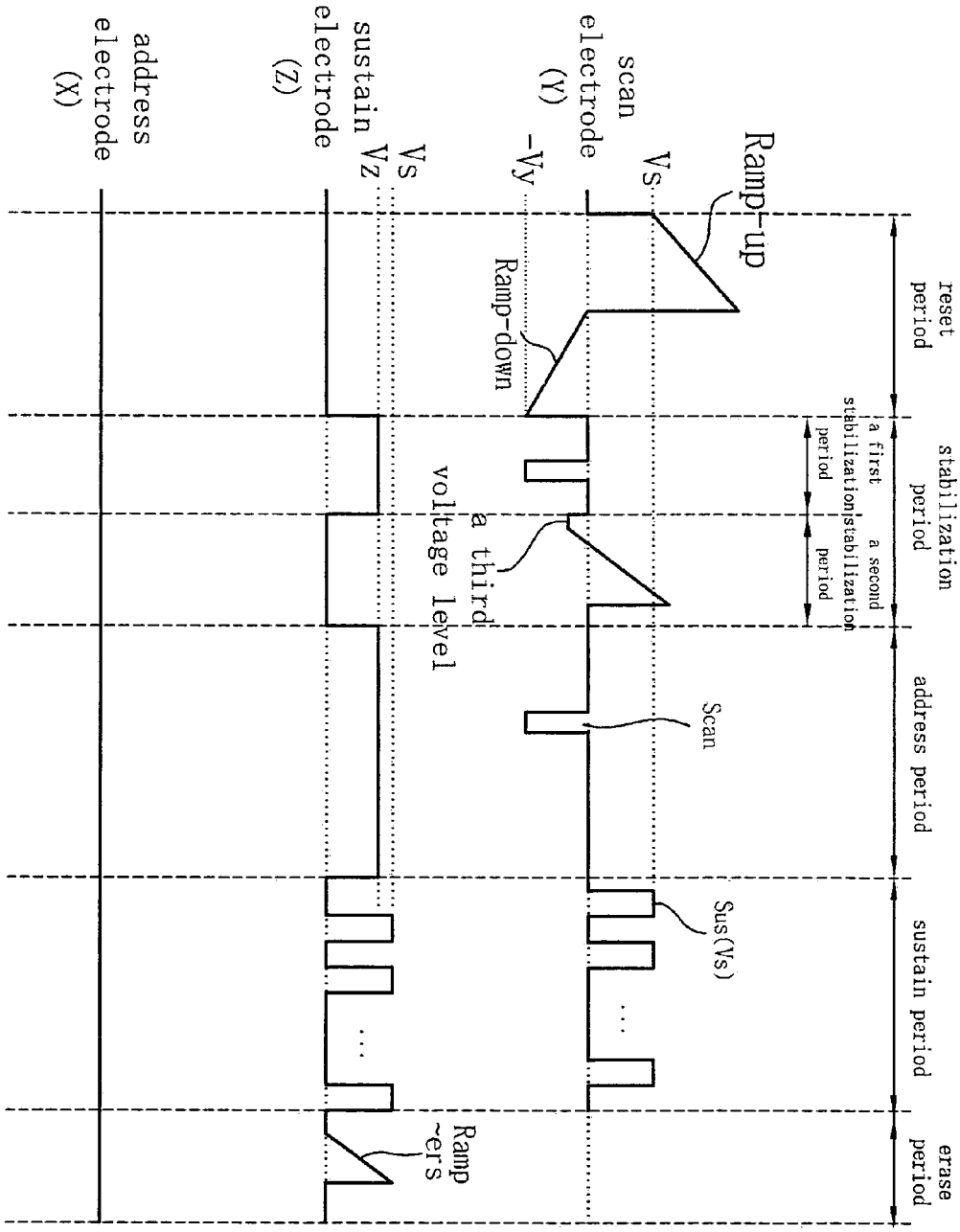
FIG. 7 illustrates still another example of driving waveforms of a plasma display apparatus according to a first embodiment of the present invention.

FIG. 7 illustrates still another example of driving waveforms of the plasma display apparatus according to the first embodiment of the present invention.

As shown in FIG. 7, the driving pulse applied in a reset period, a sustain period and an erase pulse is the same with the driving pulse shown in FIG. 5*a*. The bias voltage applied to a scan electrode Y during address period may be lower than a reference voltage. In a first stabilization period, the negative waveform applied to the scan electrode Y is applied from a second voltage level which is different from the first voltage level of FIG. 5*a*. Preferably, the second voltage level is a ground voltage. The positive rising waveform described above rises from a third voltage level. It is preferable that the third voltage level ranges from from −10V to 10V. Thus, wall charges are properly erased according to the amount of wall charges accumulated in an address electrode X.

A SECOND EMBODIMENT

A plasma display apparatus according to a second embodiment of the present invention will be described in relation with FIG. 4 and FIG. 8*a* to FIG. 10. The plasma display apparatus according to the second embodiment of the present invention is the same with the plasma display apparatus according to the first embodiment of the present invention except the sustain driver and the scan driver. Hence, the explanation on other elements except the sustain driver and the scan driver will be abbreviated.

A controller 440 according to the second embodiment of the present invention applies a negative waveform and a positive waveform by a scan driver 420 between a reset pulse and a negative scan pulse. Preferably, the positive waveform and the negative waveform are a rectangular pulse. The negative waveform described above is a pulse for erasing wall charges excessively accumulated in address electrodes X1 to Xn of the cells that are not turned on. The positive waveform described above is a pulse for erasing wall charges excessively accumulated in scan electrodes Y1 to Yn and sustain electrodes Z. To erase some wall charges, the controller 440 applies a positive waveform to the sustain electrode Z by a sustain driver 430 alternately with the positive waveform described above. The more detailed description will be given through FIG. 8*a* to FIG. 10.

The controller 440 according to the second embodiment of the present invention applies a positive waveform to the sustain electrode Z by a sustain driver 430 alternately with the positive waveform described above applied to the scan electrodes Y1 to Yn under the control of a driving pulse controller 450. In this case, it is preferable that the positive waveform applied to the sustain electrode Z is a narrow pulse.

The narrow pulse is a pulse having the width less than the width of the sustain pulse, being applied for erasing wall charges. To erase wall charges according to the present invention, it is preferable that the width of the narrow pulse is less than the width of half of the sustain pulse.

When the width of the narrow pulse is overly broad, it is difficult to erase wall charges. On the contrary, wall charges are accumulated in the cell, not erased.

Figure 8A:
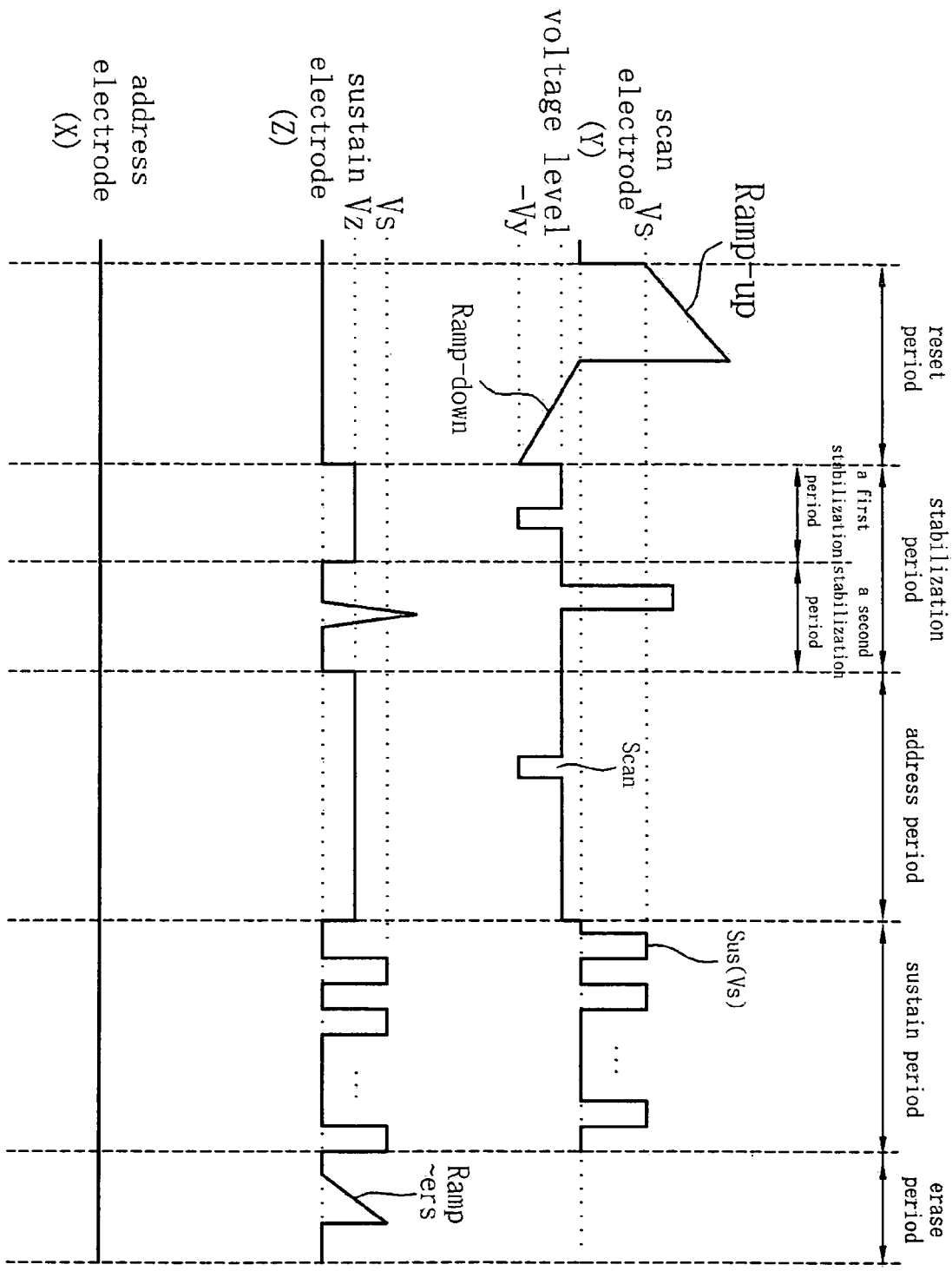
FIG. 8*a* illustrates an example of driving waveforms of a plasma display apparatus according to a second embodiment of the present invention.
Figure 8B:
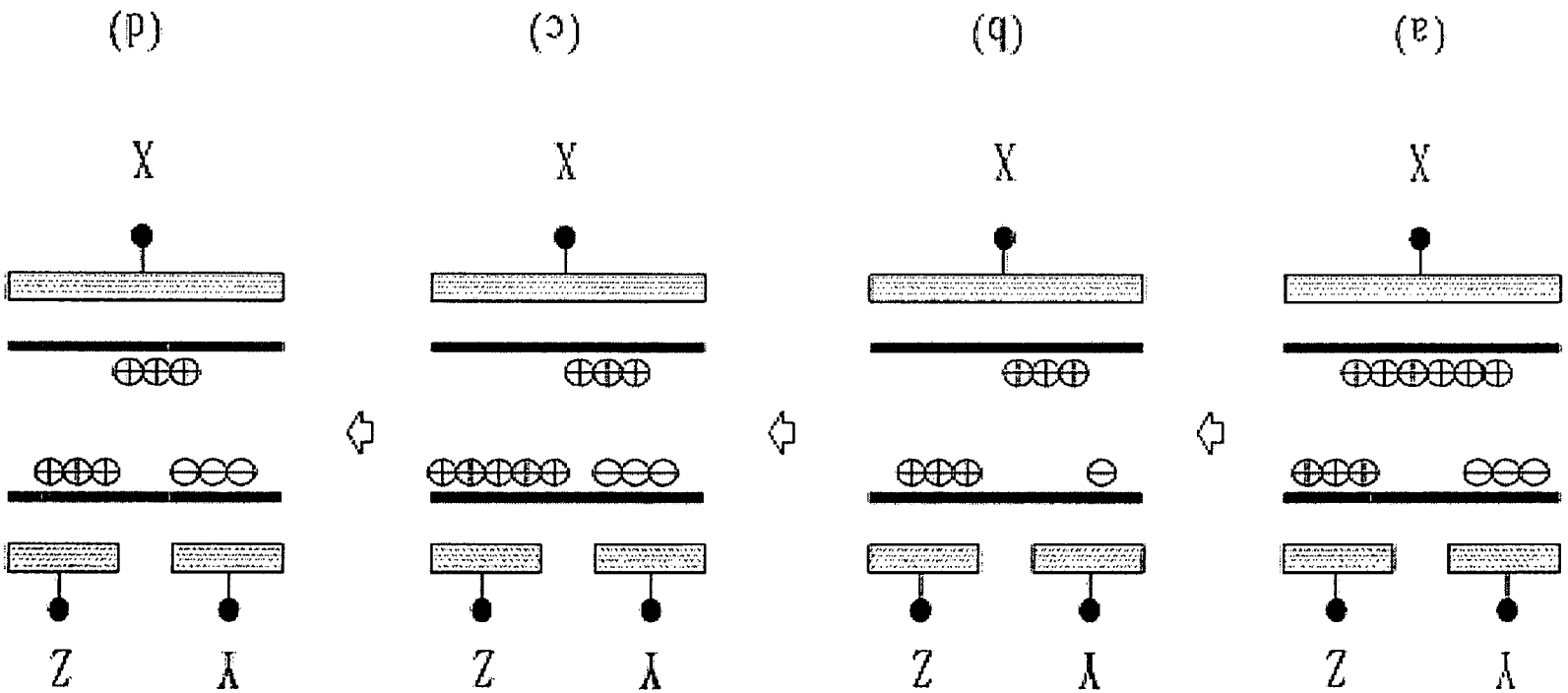
FIG. 8*b* illustrates wall charges distributed in a discharge cell due to a driving pulse according to a second embodiment of the present invention.

In FIG. 8*a* and FIG. 8*b*, the driving pulse implemented by a plasma display panel according to the second embodiment of the present invention and the distribution of wall charges in the plasma display panel are illustrated.

FIG. 8*a* illustrates an example of driving waveforms of the plasma display apparatus according to the second embodiment of the present invention.

Referring FIG. 8*a*, the plasma display apparatus according to the second embodiment of the present invention is driven by time-dividing with a reset period for initializing the entire cells, a stabilization period for stabilizing excessive wall charges within a discharge cell, an address period for selecting a cell to be discharged, a sustain period for sustaining the discharge of the selected cell and an erase period for erasing wall charges within the discharged cells.

In a reset period, during a set-up period, a rising ramp waveform Ramp-up is simultaneously applied to all the scan electrodes. Due to the rising ramp waveform, a dark discharge is happened within the discharge cells of the entire screen. Due to the set up discharge, positive wall charges are accumulated in the address electrode and the sustain electrode, while negative wall charges are accumulated in the scan electrode.

During a set-down period, a falling ramp waveform falls from a reference voltage level GND to a predetermined voltage level −Vy causes an erase discharge between the scan electrode and the address electrode in the cells. Accordingly, wall charges formed between the scan electrode and the address electrode are sufficiently erased. Due to the set-down discharge, wall charges enough for a stable address discharge are uniformly remained in the cells.

In the stabilization period, the second embodiment of the present invention selectively erases wall charges formed between the scan electrode and the sustain electrode in order to prevent an error discharge due to a residual image. To erase the wall charges, a negative waveform and a positive waveform, between the reset pulse and the negative scan pulse, are applied to the scan electrode. Preferably, the negative waveform and the positive waveform described above are a rectangular pulse, being applied from a first voltage level. Preferably, the first voltage level ranges from −90V to −7V. Preferably, the lowest voltage level of the negative waveform, that is, the peak value of the negative waveform ranges from −210V to −190V.

Preferably, the width of the negative waveform is approximately the same with or wider than the width of the scan pulse applied to the scan electrode during the address period. Preferably, the width of the negative waveform ranges from 1 μs to 10 μs. The width and the magnitude of the negative waveform according to the present invention are most properly set, therefore, it is possible to erase some of negative wall charges in the scan electrode described above and some of excessive positive wall charges in the address electrode.

When the negative waveform is applied to the scan electrode, a sustain bias voltage is applied to the sustain electrode. A narrow pulse having a width less than half of the sustain pulse width is applied to the sustain electrode, after the positive waveform is applied to the scan electrode. Preferably, the sustain bias voltage level Vz ranges from 80V to 100V which is lower than a sustain voltage. Due to the application of the negative waveform, a dark discharge is happened between the scan electrode and the address electrode.

Then, a positive waveform is applied to the scan electrode after the negative waveform is applied to the scan electrode. Preferably, the positive waveform applied to the scan electrode is a rectangular pulse, rising from the first voltage level to a voltage level that is approximately the same with the voltage level of the sustain pulse Vs applied during the sustain period after the address period. Preferably, the peak voltage level of the positive waveform ranges from 150V to 250V. A positive waveform is alternately applied to the sustain electrode with the positive waveform applied to the scan electrode. Preferably, the positive waveform applied to the sustain electrode is a narrow pulse.

Preferably, the peak voltage level of the positive waveform applied to the sustain electrode is a voltage level that is approximately the same with the voltage level of the sustain pulse Vs applied during the sustain period after the address period. Preferably, the peak voltage level of the positive waveform applied to the sustain electrode ranges from 150V to 250V. The negative waveform and the positive waveform are applied to the scan electrode Y are applied from the reference voltage.

By performing the erase discharge, excessive wall charges accumulated in the cells, which are turned off in the region representing a single color pattern during operation, are selectively erased to efficiently improve a luminescent spot problem. The more detailed explanation will be described in FIG. 8*b*.

During an address period, negative scan pulses are sequentially applied to scan electrodes, while a positive address pulse is applied to an address electrode in synchronization with the scan pulse. By adding a voltage difference between the scan pulse and the address pulse to a wall voltage formed in a reset period, an address discharge is happened within a discharge cell to which the address pulse is applied. Wall charges enough for a discharge with the application of a sustain voltage Vs are formed within cells selected by the address discharge. During the set down period and the address period, a positive bias voltage is applied to the sustain electrode by decreasing the voltage difference between the sustain electrode and the scan electrode for preventing an error discharge.

During a sustain period, sustain pulses are alternately applied to the scan electrode and the sustain electrode. In a selected cell by the address discharge, a sustain discharge or a display discharge is happened between the scan electrode and the sustain electrode by adding a wall voltage within the cell to the sustain pulse whenever each sustain pulse is applied to the scan electrode and the sustain electrode.

During an erase period after the completion of the sustain discharge, an erase ramp waveform Ramp-ers having small width and low voltage level is applied to the sustain electrode to erase wall charges remained in the entire cells.

FIG. 8*b* illustrates wall charges distributed in a discharge cell due to a driving pulse according to a second embodiment of the present invention.

Referring FIG. 8*b*, negative wall charges are formed in a scan electrode Y during the set-down period of a reset period, excessive positive wall charges are formed in an address electrode X (a). During a first stabilization period before an address period, a negative waveform is applied to the scan electrode Y, which causes that some of negative wall charges in the scan electrode Y and some of excessive positive wall charges in the address electrodes X are erased (b).

During a second stabilization period before the address period, a positive waveform is applied to the scan electrode Y, while a positive narrow pulse is applied to the sustain electrode Z alternately with the positive waveform applied to the scan electrode Y. Accordingly, excessive wall charges in the scan electrode Y and the sustain electrode Z are erased(c). Then, wall charges enough for a stable address discharge between the scan electrode Y and the sustain electrode Z are uniformly remained(d). Thus, a mistaken writing or a luminescent spot error discharge can be prevented.

Figure 9:
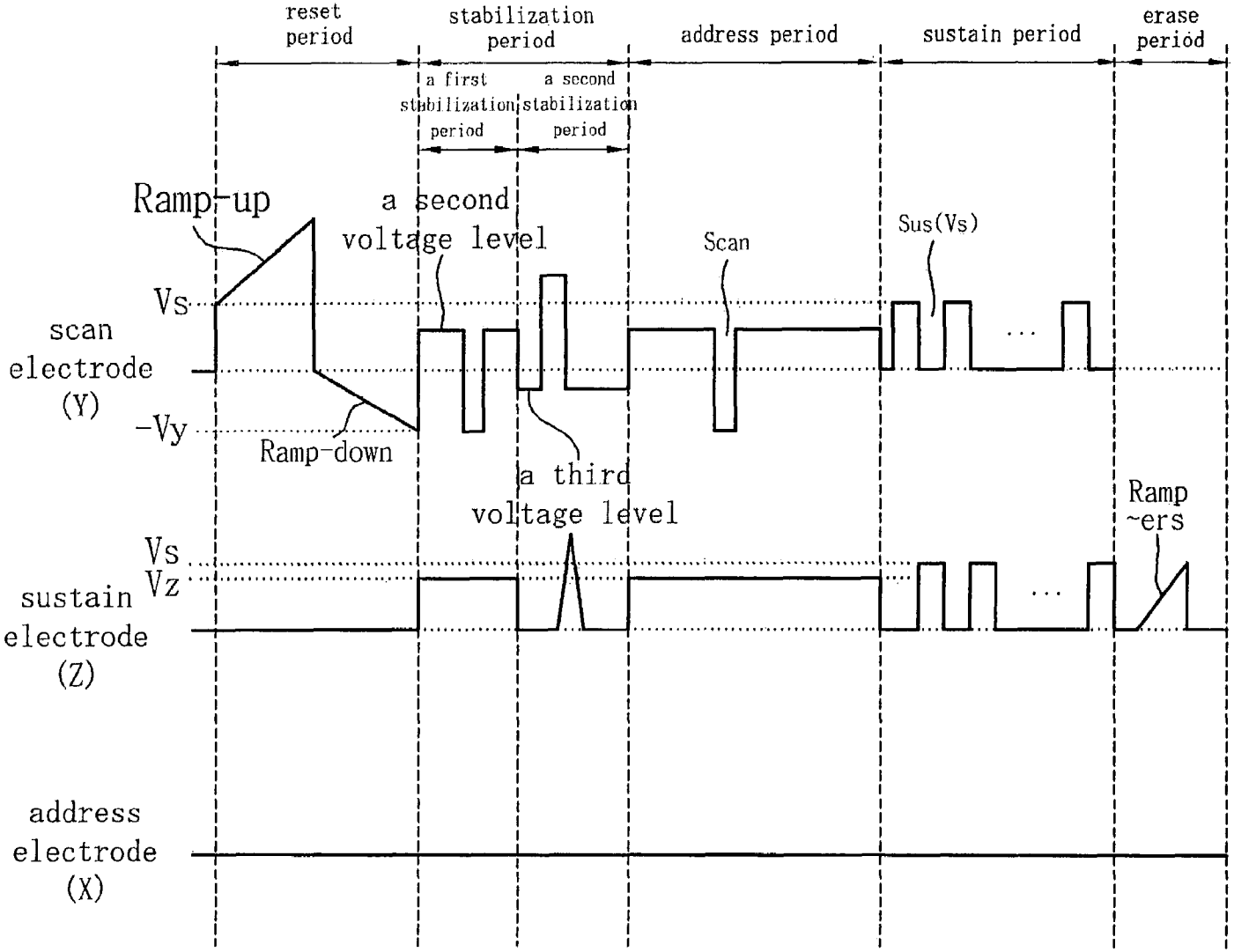
FIG. 9 illustrates another example of driving waveforms of a plasma display apparatus according to a second embodiment of the present invention.

FIG. 9 illustrates another example of driving waveforms of a plasma display apparatus according to a second embodiment of the present invention.

As shown in FIG. 9, the driving pulse applied in a reset period, an address period, a sustain period and an erase period is the same with the driving pulse shown in FIG. 8*a*. In a first stabilization period, a negative waveform applied to a scan electrode Y is applied from a second voltage level. In other words, the second voltage level, different from the embodiment of FIG. 8*a*, is positive and applied from the voltage level which ranges from 50V to 80V. Accordingly, the lowest voltage level ranges from −70V to −40V. The positive rising waveform applied to the scan electrode rises from a third voltage level. Preferably, the third voltage level ranges from −10 V to 10V. Accordingly, wall charges can be properly erased according to the amount of wall charges accumulated in an address electrode X.

Figure 10:
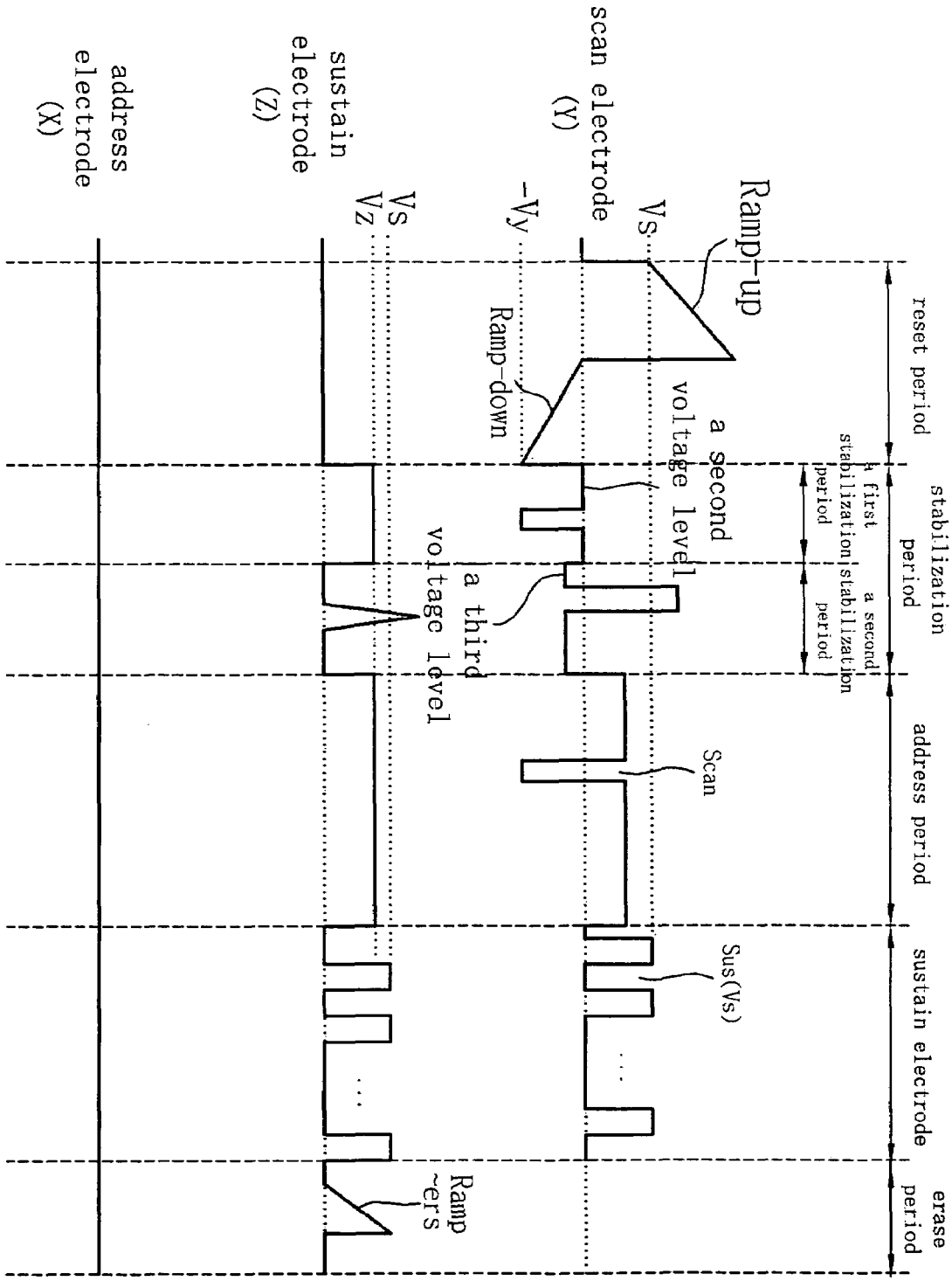
FIG. 10 illustrates still another example of driving waveforms of a plasma display apparatus according to a second embodiment of the present invention.

FIG. 10 illustrates still another example of driving waveforms of a plasma display apparatus according to a second embodiment of the present invention.

As shown in FIG. 10, the driving pulse applied in a reset period, a sustain period and an erase period is the same with the driving pulse shown in FIG. 8*a*. A bias voltage applied to the scan electrode Y during an address period may be lower than a reference voltage. In a first stabilization period, a negative waveform applied to a scan electrode Y, different from the embodiment of FIG. 8*a*, is applied from a second voltage level. Preferably, the second voltage level ranges from −10V to 10V. Preferably, the lowest voltage level of the negative waveform ranges from −70V to −40V. The positive rising waveform applied to the scan electrode rises from a third voltage level. Preferably, the third voltage level ranges from −10V to 10V. Accordingly, wall charges can be properly erased according to the amount of wall charges accumulated in an address electrode X.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display apparatus comprising:

a plasma display panel comprising a scan electrode and a sustain electrode; and a controller for applying a negative waveform and a positive waveform to the scan electrode between a reset pulse and a scan pulse having negative polarity, wherein the controller applies a sustain bias voltage to the sustain electrode when the negative waveform is applied to the scan electrode.

2. The plasma display apparatus of claim 1, wherein the negative waveform and the positive waveform are applied from a first voltage level.

3. The plasma display apparatus of claim 1, wherein the sustain bias voltage is lower than a sustain voltage.

4. The plasma display apparatus of claim 1, wherein the sustain electrode is applied with a ground level voltage, when the positive waveform is applied to the scan electrode.

5. The plasma display apparatus of claim 2, wherein the first voltage level ranges from −90V to −70V.

6. The plasma display apparatus of claim 1, wherein a peak value of the negative waveform ranges from −210V to −190V.

7. The plasma display apparatus of claim 1,
wherein the scan pulse is applied from the first voltage level.

8. The plasma display apparatus of claim 1,
wherein a width of the negative waveform ranges from 1 μs to 10 μs.

9. The plasma display apparatus of claim 8,
wherein the width of the negative waveform is substantially the same with a width of the scan pulse or wider than the width of the scan pulse.

10. The plasma display apparatus of claim 1,
wherein the negative waveform is applied from a second voltage level and the positive waveform is applied from a third voltage level.

11. The plasma display apparatus of claim 10,
wherein the second voltage level ranges from 50V to 80V.

12. The plasma display apparatus of claim 10,
wherein the peak value of the negative waveform ranges from −70V to −40V.

13. The plasma display apparatus of claim 10,
wherein the third voltage level ranges from −10V to 10V.

14. The plasma display apparatus of claim 10,
wherein the second voltage level is a ground level voltage.

15. A plasma display apparatus comprising:
a plasma display panel comprising a scan electrode and a sustain electrode; and
a controller for applying a negative waveform and a positive waveform to the scan electrode between a reset pulse and a scan pulse having negative polarity, wherein the controller applies a sustain bias voltage to the sustain electrode when the negative waveform is applied to the scan electrode,
wherein the controller applies a ground level voltage to the sustain electrode when the positive waveform is applied to the scan electrode.

16. The plasma display apparatus of claim 15,
wherein the positive waveform is a rising pulse.

17. The plasma display apparatus of claim 15,
wherein the sustain bias voltage is lower than a sustain voltage.

18. A plasma display apparatus comprising:
a plasma display panel comprising a scan electrode and a sustain electrode; and
a controller for applying a negative waveform and a positive waveform to the scan electrode between a reset pulse and a scan pulse having negative polarity,
wherein the controller applies a sustain bias voltage to the sustain electrode when the negative waveform is applied to the scan electrode, applies a narrow pulse having a width less than half of the sustain pulse width to the sustain electrode after the positive waveform is applied to the scan electrode.

19. The plasma display apparatus of claim 18,
wherein the positive waveform is a rectangular pulse.

20. The plasma display apparatus of claim 18,
wherein the sustain bias voltage is lower than a sustain voltage.

* * * * *